US006631752B2

(12) United States Patent
McDonald

(10) Patent No.: US 6,631,752 B2
(45) Date of Patent: Oct. 14, 2003

(54) MATHEMATICALLY DETERMINED SOLIDIFICATION FOR TIMING THE INJECTION OF DIE CASTINGS

(75) Inventor: John W. McDonald, Bradenton, FL (US)

(73) Assignee: DieCast Software Inc., Bradenton, FL (US)

( * ) Notice: Subject to any disclaimer, the term of this patent is extended or adjusted under 35 U.S.C. 154(b) by 0 days.

(21) Appl. No.: 10/157,515

(22) Filed: May 30, 2002

(65) Prior Publication Data

US 2002/0170699 A1 Nov. 21, 2002

Related U.S. Application Data

(63) Continuation of application No. 09/606,362, filed on Jun. 29, 2000.

(51) Int. Cl.[7] ..... B22D 46/00
(52) U.S. Cl. ..... 164/4.1
(58) Field of Search ..... 164/341, 4.1, 457

(56) References Cited

U.S. PATENT DOCUMENTS

| | | | | |
|---|---|---|---|---|
| 3,165,796 A | | 1/1965 | McDonald | 164/345 |
| 3,433,292 A | | 3/1969 | McDonald | |
| 3,842,893 A | * | 10/1974 | Booth | 164/457 |
| 4,206,799 A | | 6/1980 | McDonald | 164/341 |
| 4,493,362 A | * | 1/1985 | Moore et al. | 164/457 |
| 5,363,899 A | * | 11/1994 | Takagi et al. | 164/4.1 |

FOREIGN PATENT DOCUMENTS

JP 61276760 A * 12/1986

OTHER PUBLICATIONS

Isocline Validation and Background Canada Mar. 8, 1998.
Isocline Software–Copyrighted by Registration in Canada on Mar. 8, 1998.
Isocline Validation and Background U.S. Apr. 27, 1998.
Isocline Software Copyrighted by Registration in the U.S. on Mar. 16, 1998.
Isoclines—The Physics of the Solidification of Metals In a Die Casting Die—World Wide Web Canada Mar. 1, 2000.
Isoclines II—The Mathematics of the Solidification of Metals In a Die Casting Die—World Wide Web on Sep. 15, 2000. Registered in Canada Jun. 12, 2000.
A Treatise On The Mathematics and Physics Of The Solidification of Metals In a Die Casting Die. Submitted to US Copyright Office World Wide Web Mar. 1, 2000.

* cited by examiner

*Primary Examiner*—M. Alexandra Elve
*Assistant Examiner*—Kevin McHenry

(57) ABSTRACT

This invention discloses a method of improving the die casting process by the application of the inventor's mathematics and physics stored in a computer to control the injection speed and the timing of the excitation of an intensifier. Using either data from a die surface temperature for a selected location detected by a pyrometer, the last instant before the die is closed, or the alloy-die interface boundary data from a thermocouple, the inventor's equations loaded in a computer calculate and graph the solidification pattern for the casting wall and the quantity of heat remaining in the alloy wall vs. time above the dynamic solidus thereby establishing parameters for control of facets of the injection phase. The unique properties of the boundary's transient temperature during solidification have been shown by the inventor's mathematics to be of vital import to the determination of the solidification pattern used to control injection. The transient boundary temperature can be determined by either the inventor's equations or by the varying output of the die surface mounted thermocouple with the thermocouple being preferred. A typical injection pressure time graph is plotted in the computer software program from a pressure transducer in the hydraulic injection system for comparison with the solidification pattern for control of the fill time, somewhat automatic as the most desirable method.

9 Claims, 3 Drawing Sheets

Typical Casting Machine and Die With Thermocouple

MATHEMATICALLY DETERMINED SOLIDIFICATION FOR TIMING THE INJECTION OF DIE CASTINGS (Reference is made here to the parent application Ser. No. 09/606,362 filed Jun. 29, 2000. This application and the parent application have their origination in the inventors development of the mathematics and physics of the solidification of metals in a die casting die resulting in a number of copyrights, ©Isoclines Validation and Background 1998, a computer software program ©1998–2002 Isoclines, and the inventor's treatise "Isoclines—A Treatise on the Solidification of Metals in a Die Casting Die© 2000". Application Ser. No. 09/606,362 intends to patent the application of the inventors software program based on his treatise, containing his science as a means to improve control of the injection of die castings. This application's intent, also founded on his treatise, is to patent the process based on the inventors mathematical equations for determining the time for the solidification process of the injected alloy and use it to set limits for the injection speed in the die casting process.)

BACKGROUND OF THE INVENTION

"A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever."

The quest for a "solidification time" began in the early 1950's when Doehler-Jarvis Corporation constructed a 2000-ton machine demonstrating the capability to produce castings weighing more than 70 pounds. Previous die casting machines were limited to 800 tons of locking force, maximum and could only produce castings weighing up to approximately 2 pounds. The "solidification time" it was believed would indicate on the basis of the wall thickness, the alloy temperature and the die temperature time, the maximum time allowable to fill a casting of given weight (volume). The hypothesis was that the temperature of the solidifying metal in the thinnest wall of the casting could not fall below the solidus point of the alloy before the cavity was filled and a high static pressure applied to the molten metal.

Perhaps the first reference to the concept of "solidification time" in relation to "fill time" can be found in H. H. Doehler's 1951 book, "Die Casting", McGraw-Hill Book Company, in two statements. "In the final analysis, the last portion of metal necessary to complete a casting must enter before the portion that entered first has solidified. It therefore follows that injection speed is one of the most important variables in die casting." Doehler determined a relative injection speed for a number of zinc and aluminum alloys, stating which alloy should be injected faster than another does but gave no absolute values.

Subsequent researchers produced solidification times either based on empiricism or formulated equations based upon a rationale of classical metallurgy. In 1957 J. Lapin formulated a table for the "solidification times" of various wall thickness and metals in his "Analytical Approach to Gate Design", This empiricism was one of the earliest attempts to quantify a number for the time in which a die cavity had to be filled. Following the postulate that to produce a high quality die casting the die caster should fill the die cavity before the alloy reaches the solidus or final freezing temperature, F. C Bennett, Dow Chemical Company, in "Designing Die Casting Dies to Work on Early Shots" presented an equation in November 1966 for the filling time. Bennett's equation assumed half of the thermal energy above the solidus was concentrated at the mid-plane of a given wall and calculated the time for this energy to drop through a gradient determined by the molten alloy-die surface temperature difference.

Bennett's equation is: $\theta = q*x/(k*S(tm-td))$ where: θ=the maximum fill time in seconds, S=surface area (square inches), tm=mid plane alloy temperature (°F.), td=die surface temperature (°F.)

x=midplane-to-die distance (inches), q=the heat flow during fill time θ, (Btu)

In 1965, culminating three years of research sponsored by the American Foundrymen's Society, the American Die Cast Institute, and the International Lead, Zinc Research Organization, Wallace, J. F. and Stuhrke W. F., Case Institute of Technology "Gating of Die Castings", developed the constant flux model for heat flow in a die casting die. A series of equations were formulated which permitted the prediction of temperature-time curves for the steel die surface to which the heat from the molten alloy was being transferred. The equations of the researchers were erroneously based on the linear flux model of Franz Neumann, "Die partiellen Differentialgleichungen der mathematischen Physic, Wallace, and Stuhrke placed a thermocouple in the surface of a die casting die which cast alternatively ⅛ inch or ¼ inch plates of zinc alloy, Zamak 3 or aluminum alloy 380. Relying on classical metallurgy, i.e. 1) that the superheat (heat above the liquidus) flowed out of alloys before the heat of solidification and 2) the alloys must fill the cavities while their temperature is above the classical solidus the Case researchers searched for an impediment to the heat transfer from alloy to die. This study produced considerable quantitative and supportive data, which has aided the die cast industry even to the present date but did not result in a scientific basis for the solidification of metals in a die casting die.

Also accepting the classical metallurgy hypothesis, which necessitated a "film coefficient". was C. W. Nelson, Dow Chemical Company, "Nature of Heat Transfer at the Die Face". To conduct his study with the goal of finding a "solidification time" Nelson mounted five thermocouples in a die casting die which produced a 3"×8"¼" thick magnesium AZ91 alloy plate similar to the Wallace work and produced die temperature recordings. One of the thermocouples was exposed at the surface and measured the AZ91 boundary temperature as the casting die would sense it. Based on the die surface temperature recordings Nelson drew a magnesium boundary surface profile above the thermocouple die temperature curve for the time frame that he perceived. The assumption was made the magnesium curve commenced at the liquidus line and decayed from this point. Nelson then proceeded to calculate the "film coefficient" factor "h" for the superheat, the matrix, and finally the solidified cooling magnesium.

In spite of the inability to demonstrate a sound technical "solidification time" devices had been produced which could measure the hydraulic pressure in the cylinder used to inject the metal into the die. The generic name for such a device is hydrauliscope and in its simplest versions consists of a pressure transducer located in the inlet of the injection cylinder with the analog output of the transducer converted to digital then being fed to a computer. The computer display of the transducer output will have the pressure variable plotted on the vertical axis and time on the horizontal. Significant events in the injection cylinder displacement of molten alloy correlate with pressure changes. A pressure rise occurs when the injection cylinder and piston have traveled such that molten metal now must be displaced through the ingate orifice to the casting and the resistance to the cylinders movement increases. When the cavity has filled and further displacement of metal is not possible the kinetic energy of the moving injection mechanism and fluid in the cylinder is dissipated and its dissipation is revealed by a sharp rise in the pressure followed by a damped oscillation of the pressure. The "fill time" is therefore the difference between the readily detectable sharp rise signaling the die cavity is full and the earlier pressure rise, well recognized as the time when metal commences to flow into the cavity.

Without considerable precision in the determination of the "solidification time" the "fill time" must depend on the experience of the user. Following the Nelson work in 1970 the quest for the "solidification time" was largely abandoned until the inventor decided to readdress the problem. In 1961 the inventor attempted to solve the problem on the basis of the concept of a temperature gradient between the center of an alloy wall and the die surface but found due to the unavailability of elevated temperature properties for the die cast alloys and restricted computer capability it could at best be a crude approximation. By 1996, computers with state of the art hardware and software were available at the retail level for several thousand dollars, which were more powerful than those costing several millions in 1961.

Essential to the advancement of a science in the transient supercooling and solidification of metal in a die casting die was the formulation of a mathematical analysis that was not an empiricism and had its roots in traditional mathematical approaches to heat flow problems. In late 1996 the mathematical approach to a solution to the solidification of metals in a die casting die through a unique dual Fourier series analysis had been demonstrated to be feasible, and by the first quarter of 1998 a software program had been copyrighted. One of the Fourier series analyses gives the temperature for the alloy as a function of time and depth, a second yields time vs. depth and temperature in the die material, a third equation calculates the boundary surface between the die and the solidifying alloy and a fourth calculates the heat remaining in the alloy wall above the "dynamic solidus" defined below.

Unfortunately, the initial mathematics used classical metallurgy and a film coefficient due to the convincing work of the researchers of the late 1960's. This software gave excellent results in duplicating the die surface temperatures recorded by Nelson in his work with magnesium alloy AZ91B and Wallace and Stuhrke's thermocouple work with aluminum alloy SC84. Both of these alloys have relatively broad temperature differences (>100° F.) between their liquidus and solidus temperatures. The classical metallurgy thesis and the "film coefficient" theory failed, however, when alloys with narrow differences (15° F.) between the liquidus and solidus existed such as aluminum 13 alloy and zinc alloy AG40A. The mathematics showed these highly castable alloys had to be fluid while the boundary temperature between the alloy and the die, during the entire "filling" time were below the classically defined solidus. This work resulted in the proof that molten metals injected into a die casting die are supercooled i.e. they possess the properties of a liquid even though the metal's temperature is below the classical metallurgical solidus. All of the phenomena, which caused previous researchers to hypothecate a film coefficient, could be explained on the basis of supercooling and this became one of the physics postulates of the inventor.

Thus the hypothesis that the temperature of the solidifying metal could not fall below the solidus point of the alloy before the cavity was filled was demonstrated to be incorrect.

Further, the inventor's science and software program showed the process by which alloy walls temperatures reach a value at which liquid metal can not exist.

With the "film coefficient" hypothesis shown to be invalid, based on the inventor's mathematics the inventor then formulated the remaining physics postulates for the solidification of metals in a die casting die. These are set out in eleven physics postulates, and are included with the mathematics and a syntagma in a literary copyrighted work entitled "Isoclines—A Treatise on the Solidification of Metals in a Die Casting Die© 2000" with that copyrighted work in its entirety available for downloading from the inventor and author's WebSite. The most important facet of the treatise to this invention is the inventor's development of the uniqueness of the boundary surface temperature between the solidifying alloy and the die and the laws governing it as expressed in the mathematical equation for the boundary temperature.

It is not uncommon in the die casting process to use a hydrauliscope to produce a pressure versus time graph of the injection cylinder hydraulic pressure. Prior to formulation of the inventors mathematics and physics and this invention, there was not a scientifically based solidification thesis on which to base the speed of injection of alloys in pressure die casting. The use of hydrauliscope recordings was an empirical one. When acceptable castings were obtained the hydrauliscope recording of the pressure-time relationship used to produce that casting was preserved and set as an empirical standard. Hydrauliscopes are also used for detecting cylinder piston leaks and inadequate pressure. The establishment of a "filling time" was entirely based on the die casters experience with a tendency to believe faster was better since a scientific determination of the solidification in a die casting die did not exist. The tendency for faster injection, however, does have a penalty associated with it, for if the injection is too fast and without some losses of heat the extremely fluid molten metal cannot be contained in the die. There are no hydraulic seals in a die casting die for shutting off the escape of liquid metal under high pressure, and the prevention of the leakage of liquid metal relies upon the solidification of microflash along all parting lines for forming a type of gasket. If the metal is injected faster than this microseal of flash can develop, the hydraulic cylinder will "bottom" against the ejector die after forcing liquid metal beyond the confines of the die.

The fallacy of "faster shots are better" is compounded when it extends itself to believing that larger machines with greater locking force will somehow overcome the fact of the non-existence of hydraulic seals in a casting die. The lack of an explanation for the metal solidification phenomena in a die casting die has resulted in large aluminum castings being produced in many instances on 3500 ton die casting machines which can readily be produced at higher production rates and in better quality from 1750–2000 ton die casting machines. The higher temperatures of dies producing castings in the faster cycling smaller machines will result in better quality at lower cost. Further the faster cycling smaller machines possible with a scientific use of this invention obviates the need to heat oil based substances and circulate them through the die to raise its temperature to an acceptable temperature range.

At the other end of the spectrum an excessively long duration for the injection of molten metal into the casting die will result in the metal being so viscous, due to its partial solidification, as to dissipate the injection pressure without filling the cavity.

In the next two paragraphs are definitions of terms that will be used throughout.

By definition, Isoclines, referenced herein are cooling lines of constant depth in a casting wall of metal solidifying in a die casting die with the temperature of these lines being calculated and plotted as a function of time. Referenced herein is the inventor's copyrighted software program, "©1998 Isoclines", for calculating Isoclines through the mathematics and the physics of the inventor which has the ability to alternately receive the transient boundary temperature signal from a die surface-mounted thermocouple or calculating the boundary with one of the equations of Isoclines. The computer software program, "©1998 Isoclines", uses Microsoft Excel spreadsheets for calculations, data storage, drawings, and plotting and employs Microsoft Visual Basic as the programming language to order the calculation of Isoclines equations. "©1998 Isoclines" software will be defined herein as simply "Isoclines©". The development of programmable software languages and techniques has kept pace with the rapid development of computers and there are numerous "canned" software programs, which can perform the calculation of the inventor's equations. The use of any of the commercially available computers containing a software and program language which will perform the calculations of the inventor's equations will be said to be a "preferred computer software program" or simply a "preferred software program". Stored in the preferred computer software program are the thermal properties of the alloy being cast as well as the thermal properties of the die material. The pouring temperature, the initial die surface temperature, and the wall thickness of the casting are also stored in the software program. The die thickness is taken as thick enough that in time interval for injection, the heat flowing into the die is insufficient to affect the temperature at that depth. This has been shown to be less than 10 times the casting wall thickness, reasonably attained in any practical die casting die.

The "fill time" is defined earlier as the difference between the point of the characteristic rise in the hydrauliscope pressure plot associated with the cessation of the metal flow into the cavity minus the earlier pressure rise associated with the increased resistance encountered when molten metal begins to flow through the ingate to the cavity. The dynamic liquidus is defined as the temperature at which solid first forms in the transient solidification of metal in a die casting die and is a function of the flux rate across the boundary. Lastly, the dynamic solidus is defined as the temperature at which the last of any liquid metal has become solid in the transient solidification of metal in a die casting die and is a function of the flux rate. The "dynamic solidus" may be distinguished by a plateau but may also need to be determined by the degree of convergence of the Isoclines.

To obtain the graph of the boundary temperature of Isoclines from the mathematics of the inventor the thermal conductivity of the alloy must be known or developed as well as the "dynamic liquidus". The high temperature thermal properties of the die material must also be known but in general for the commonly used die material H-13, these are readily available. From a single charted thermocouple recording of the boundary interface between the die and the alloy the alloy conductivity as a function of temperature can be determined and Isoclines can then be calculated for other wall thickness, initial die temperatures and alloy pouring temperatures.

Isoclines now permits the judgment for a "fill time" to be made on a scientific basis such that the filling of the cavity is optimally achieved between the dynamic liquidus and dynamic solidus and further aiding the judgment of when to start the intensification cycle and how long to maintain this higher pressure. Injection pressure intensifiers are hydraulic pressure multiplier devices and their use is typical rather than novel.

The definition of "art" is (a) A non-scientific branch of learning, (b) A skill that is attained by study, practice, or observation. The field of die casting is replete with examples of the art of using thermocouples to achieve an improvement of sorts in the process. There are, however, no precedents in the die casting field for the application of a thermocouple based on a science for determining the solidification process of injected metals to control the process as McDonald's process improvement discloses herein. In fact the solidification "time" itself was the subject of speculation until the publication of the inventor's treatise. With the physics postulated in February and March of 2000 a science in the solidification of metals in a die casting die was born.

Prior "art", however, does exist for the use of thermocouples to "trigger" a process control in various casting operations such as turn on or off a water line. As far back as the 1950's some practitioners of die casting have even used computers to affect process control, however, they all were artful uses.

Dow Chemical Co. in 1971 received U.S. Pat. No. 3,583,467 that had two thermocouples embedded in the die to control water-cooling to maintain the die temperature in a specific range. While the goal of the use by Dow of thermocouples was to balance the heat in the die never the less the temperatures to which Dow was attempting to control that balance were experienced based. The data from the thermocouples were not subjected to analysis for improved control and the thermocouples were used only as limiting devices.

A similar use is shown in U.S. Pat. No. 5,363,899 of Takagi et al. Takagi states column 5 line 64 "The thermocouple 2 is held by a spring to ensure close contact of the tip of thermocouple 2 with the die at the measuring point." In column 2, line 8, Takagi et al notes that the thermocouple "measures a die temperature" and at line 13 states that this temperature "compares with a reference value." It is clear Takagi's method involves empiricism's and "art" and a computer is used only for comparative purposes and elimination of human error. While it can control human error Takagi's empiricisms are subject to error and do not have the capability of science. It is clear McDonald's method represents a useful improvement over Takagi's method of comparing current data from thermocouples with reference values. No attempt is made in Takagi's method for the use of a computer to do analysis on the thermocouple data for improved performance and it serves only as a limiting device.

McDonald's method can determine the necessary alloy solidification pattern from use of thermocouple contact with the casting at the die surface of from an initial die surface temperature just prior to the die closing. The preferred method is to determine the transient boundary temperature from a die-surface mounted thermocouple providing data throughout the solidification temperature range of the alloy. To calculate the boundary temperature for the solidification range of the alloy, there are alternatives to a die surface thermocouple for determining the initial die temperature. These are contact with a surface pyrometer at the desired location or directing an optical pyrometer at the chosen location the instant before the machine closes. Flexibility in selecting the location is the greatest advantage of a pyrometer method. Preferred, however, is the transient temperature data for the casting surface from a die surface embedded thermocouple i.e. essentially the interface temperature between the die and the molten alloy. This data subjected to analysis by a computer with the mathematics and physics of McDonald in a computer plots the solidification process, Isoclines, as a function of time and depth in the wall of the casting at the point where the thermocouple is located. This permits the setting either manually or automatic of the injection time and intensification time of a subsequent casting on the basis of science, an improvement over the art and empiricism of Takagi.

Booth in patent U.S. Pat. No. 3,842,893, teaches a control on the injection parameters of liquid metal in the low pressure permanent mold process which due to the refractory coating on the mold has a solidification time greater by 100 fold than the solidification time in pressure die casting. Booth's patent is in the permanent mold process category and not die casting as referenced in the United States. Booth does not claim to reference a data set of temperatures. Specifically Booth teaches verbatim column 1 line 52: "Thus . . . sensing when the casting material has reached a desired temperature, e.g., when it has solidified, this will be called the datum point, and thereby generating a signal and using this signal to terminate the application of gaseous pressure preferably automatically and preferably also to initiate the die opening sequence either immediately or after a set delay period." Booth uses a thermocouple to sense when the metal in the die has solidified while McDonald's method analyzes thermocouple data before the metal has solidified and with his mathematics and physics determines how the metal is solidifying so that the metal can be properly injected in a subsequent cycle. Booth uses a thermocouple solidus temperature detection to initiate an action where McDonald's invention is no longer interested in the thermocouple data after a solidus would be reached. With consistency and repeatability key elements in the production of high quality die castings the next casting produced by this invention benefits materially from control of the injection based on the Isoclines from the previous cycle.

McDonald's method is basically superior in consistency to that of Booth by virtue of the science applied to the use of a thermocouple when calculations are made using the mathematics and physics of the Isoclines Treatise to determine the split second solidification processes development.

In U.S. Pat. No. 4,493,362, Moore et al., teaches process control and injection control through the use of numerous thermocouples. Moore, however, goes further than Takagi and presents a formula at column 7 line 57 for the cavity fill time not the solidification of the alloy using a measured data point temperature for the metal in the gate runner in his formula. Moore makes no claims that his formula relates to the progress of solidification in the die cavity. It is presumed this is an empirical formula for nowhere does he indicate the origination of the formula. This empirical formula can be found to be lacking for it does not contain a basis for assuring that the injection will occur prior to the passing of the dynamic solidus" time, or for that matter any solidus. Moore's formula uses a liquidus temperature for the alloy. Additionally, the formula fails to incorporate the traditional thermal properties of specific heat, density, thermal conductivity and diffusivity of the alloy and the die material essential to determine the solidification taking place in the die cavity. Moore has several thermocouples, 112, 114, column 5 line 33, embedded deeply in the die casting die essentially serving the same purpose as Takagi et al. registering data points within the die and not at the surface of the casting. Moore also has a thermocouple 96 at column 5 line 8 whose function is to control the quantity of metal transferred from the furnace to the cold chamber. Finally, Moore has a thermocouple 80 column 4 line 65 located at the impact bushing that functions to sense the temperature of metal (a data point) flowing from the cold chamber to the die cavity. Nowhere does Moore teach the utilization of a thermocouple in contact with the molten casting wall at a boundary surface with the die. Therefore, Moore cannot determine the transient temperature rise and fall which are indicative of the "dynamic liquidus and solidus" of the scientific method of McDonald. Even if Moore did detect the transient boundary, he nowhere indicates in describing his process improvement, that his method has a mathematical equation to analyze such a boundary and produce a solidification pattern.

None of the cited prior art patents uses a thermocouple method, which is truly scientific, nor do the inventors claim the use of a science in the solidification process of the metals cast in applying their art. Each relies on empiricisms, prior experience parameters, and "art". None applies a science-based mathematics and physics to the use of a thermocouple.

It should finally be pointed out that Moore and Tajagi use a thermocouple to record a die temperature and they never suggest they desired or intended to use a thermocouple to detect a casting temperature while it is explicit in McDonald's invention that a casting surface temperature is desired from a thermocouple imbedded in the surface of the die.

During the last fifty years there have been a number of massive usage changes between the commonly die cast alloys of zinc, magnesium and aluminum driven by price or scarcity or both. To convert the production of, for example, an automotive transmission case from aluminum to magnesium would require a considerable learning curve for those producers using empiricism or reference values before their process could have affective controls. McDonald's method relies on science and would optimize injection performance almost immediately and that optimized level based on science in every instance would be superior to empirically optimized performance and the invention disclosed herein is a useful process improvement.

The following presents a method of improving the production of die castings which utilizes the mathematics derived and the physics discovered in the inventors copyrighted work entitled "Isoclines—A Treatise on the Solidification of Metals in a Die Casting Die©" 2000.

SUMMARY OF THE INVENTION

The broad object of this invention resulting from the mathematics and physics of the solidification of metals in a die casting die, developed by the inventor and embodied in Isoclines© is to replace guesswork and empiricism with a science for establishing and controlling the fill time i.e. the injection speed and intensification of molten metal into a die casting die, providing a method for more consistent die casting quality as largely typified by improved soundness. However, the method disclosed provides many other advantages as well, not the least of which is a safer process.

A specific objective of this invention is to assert control of the injection process through Isoclines determined from a calculated alloy-die interface boundary temperature whereby the essential input of the initial die surface temperature into the inventor's equation for determining the transient boundary temperature, is determined by a die surface thermocouple, a surface contact pyrometer or an optical pyrometer. For this objective and all objectives the alloy pouring temperature, the alloy thermal properties, the die material thermal properties, and the casting wall thickness must all be stored in the preferred computer software program.

A specific and preferred object of this invention is to utilize the uniqueness of the alloy-die interface temperature boundary, i.e. the casting surface temperature, discovered by the inventor, by feeding a die surface mounted thermocouple output into the preferred computer software program to replace a calculated less accurate alloy-die temperature boundary for establishing control of the injection speed and intensification of molten metal. The process controlled in this manner as opposed to a calculated boundary, will reduce error in the transient temperature emanating from alloy and die material thermal properties. An objective of this invention is to use the digital input to the preferred software program from the alloy-die temperature boundary thermocouple to obtain more accurate calculations of Isoclines than is arrived at using published and derived thermal properties of the metal alloy and the die material for a calculated boundary temperature.

A more specific objective of this invention is to control the duration of time for the injection of metal into a die casting die i.e. the fill time, through a comparison of this fill time as traditionally displayed by a hydrauliscope with the convergence of calculated Isoclines or the dynamic solidus plateau for the cooling alloy. Pragmatically, the convergence of Isoclines or the dynamic solidus signals the end of solidification and the comparison recognizes the low probability of injecting metal into the die if all that remains is solid metal flowing in the cavity. The cavity should be filled in a time less than it takes for the solidifying metal to cool to the dynamic solidus.

It is an objective of this invention to use the preferred computer software program to calculate the heat flow out of the alloy as a function of time, or alternatively the heat remaining in the molten alloy above the dynamic solidus at any given time to aid in determining and setting the "fill time".

Similarly, the accuracy of the calculated quantity of heat diffused to the die, as a function of time by the preferred software program will be improved by using the digital input from the alloy-die temperature boundary thermocouple to the preferred computer software program to make this calculation for controlling the fill time.

A further object of this invention is the extension of the range of parts that can be produced by the die casting process through the improved soundness possible in an embodiment of this invention.

Another objective of this invention also is to provide improved safety by assuring the cavity is never filled so fast as to have been completed in the interval of the dynamic liquidus plateau since the fluidity is extremely high at this time and would permit hot liquid metal to be forced out through the parting plane of the die i.e. the action known as "spitting".

The injection speed is a function of the injection cylinder pressure. An object of this invention is to avoid undue pressure i.e. excessive injection speeds through a more scientific determination of the required fill time and can result in smaller faster die casting machines being used for a given casting and thereby greater productivity and reduced scrap.

It is an object of this invention that a pressure transducer in the injection cylinder be fed to the preferred software program so that it can be plotted to validate the fill time through a comparison with the convergence of the Isoclines, the dynamic solidus, or the calculated heat remaining in the alloy above the dynamic solidus.

This invention is for controlling the duration of time for the injection and intensification of metal into a die casting die through the inventors mathematics and physics thereby improving the die casting process. The controls possible with the inventors equations permits a more scientific determination of the machine size for a given casting, improved quality, improved safety, greater productivity, and reduced scrap.

It is an object of this invention to use the alloy-die temperature boundary data input along with the given conditions, certain thermal properties of the alloy and the thermal properties of the die material stored in the computer software to determine the thermal conductivity of the molten alloy above the dynamic solidus. The inventors equation for the boundary temperature below show that the conductivity of the alloy above the solidus can be obtained by fitting a calculated boundary plot to the plot of the die surface-mounted boundary thermocouple output for the same initial conditions and therefore has value as a scientific tool. The thermal properties of the die material must be known as a function of temperature for this objective. Producers of die materials which are in the main steel companies and technical societies for materials research have published such thermal properties. The mathematics and physics of the author-inventor and the copyrighted software, applied to the die casting process in this invention, are key elements in a hitherto non-existent science on the solidification of metal in a die casting die.

Other objects and advantages will be obvious from the following Detailed Description of the Invention.

DETAILED DESCRIPTION OF THE INVENTION

Figure 1:
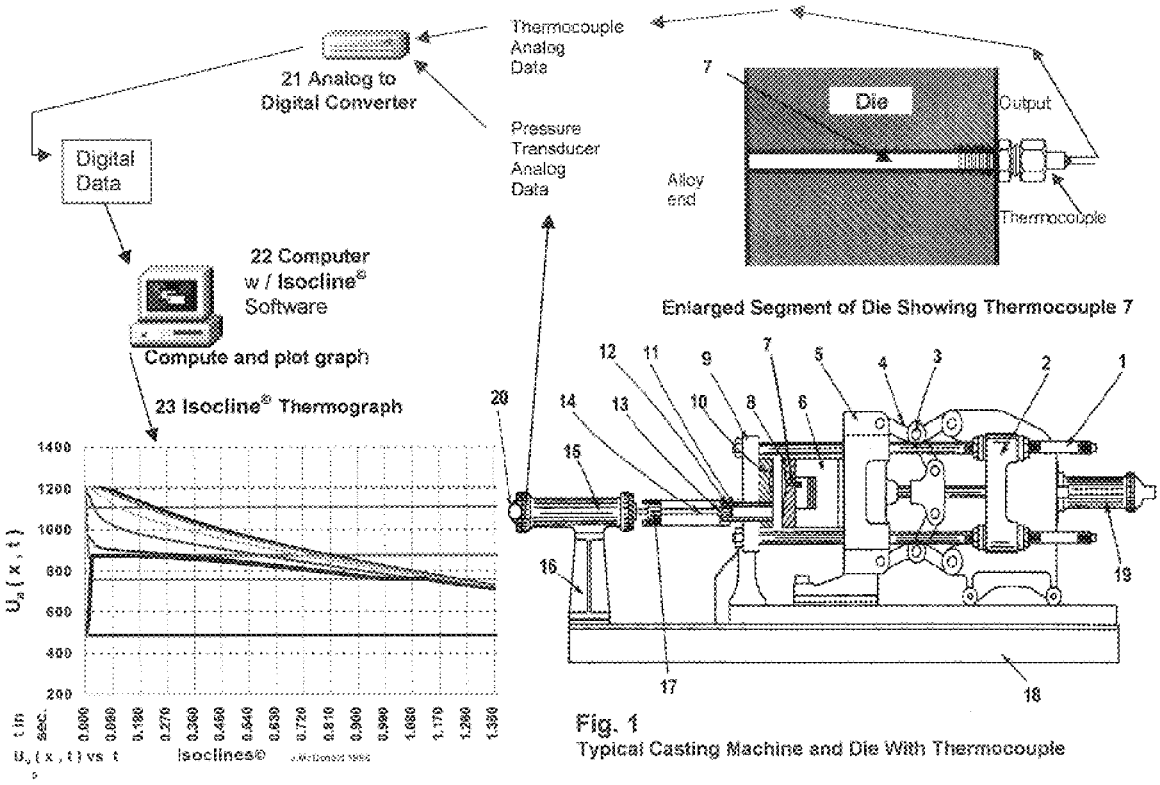
FIG. 1 is a somewhat schematic diagram, embodying the principles of the invention, illustrating the manner in which analog data from a pressure transducer mounted in the injection cylinder of a die casting machine and the analog data from a thermocouple mounted in a simple die casting die flows through an analog to digital converter and thence to a computer where the pressure transducer data is used to plot a hydraulic pressure vs. time curve and where the thermocouple data is entered into the preferred computer software program, not necessarily Isoclines©, to calculate and plot the Isoclines graph 19 of $u_a(x<=d, t)$.
Figure 2:
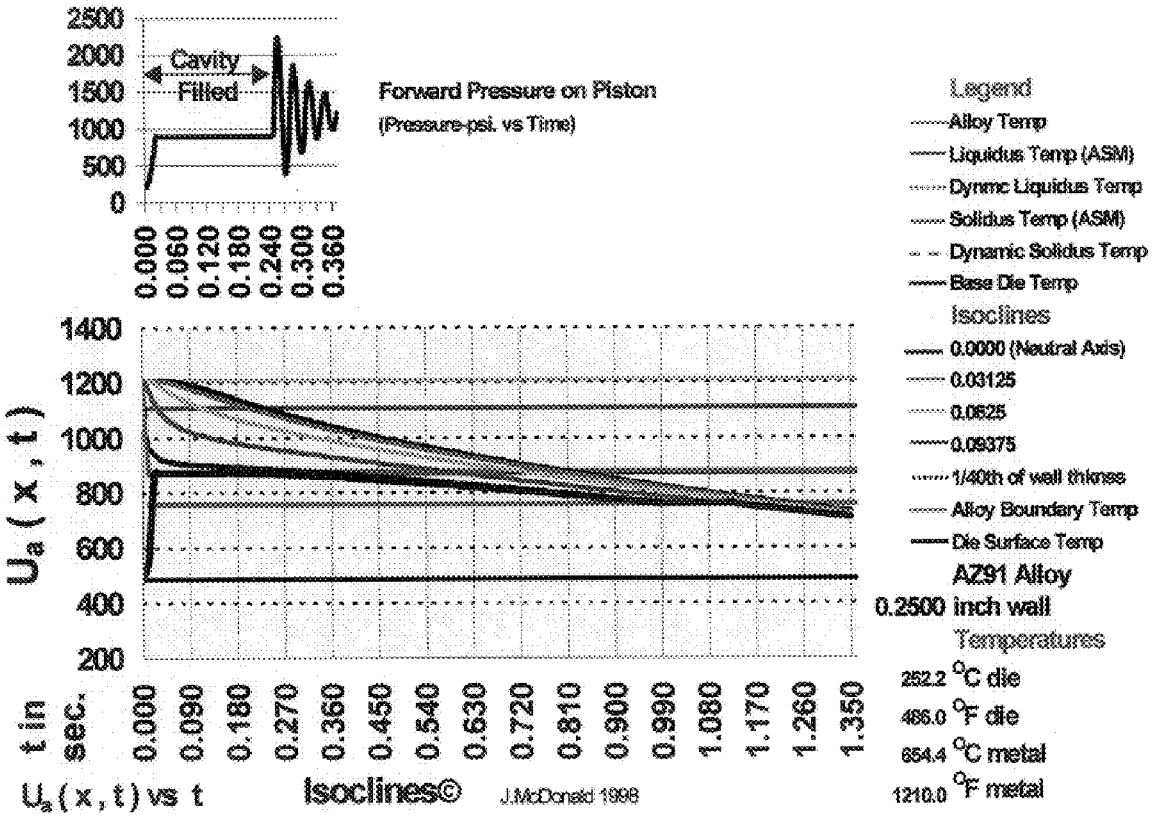
FIG. 2 is one of many options for comparison of the injection cylinder pressure vs. time curve with an Isoclines graph so that control of the injection time can be affected, either manual or automatic, by the computer. It should be noted that the upper graph is not a complete hydrauliscope plot of the injection pressure. Only the portion of the hydrauliscope data that commences with the time the metal begins to flow through the ingate to the cavity and ends with the damping of the injection system kinetic energy is useful and plotted.
Figure 3:
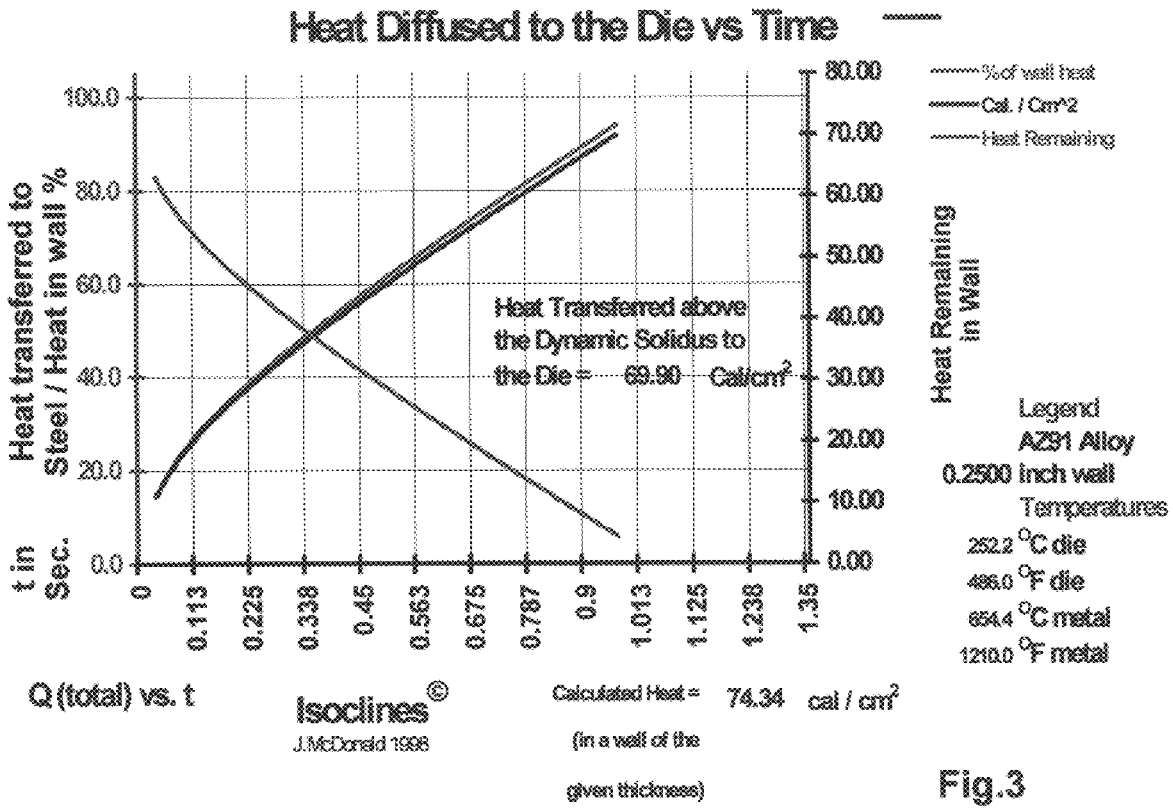
FIG. 3 is a graph of the "Heat Diffused to the Die vs. Time" which is necessary in setting the time for the completion of the metal injection on this basis. The equation for the heat diffused is developed in the Isoclines© treatise.

Reference below is made to FIGS. 1, 2, and 3, and to the referenced character numbers of FIG. 1.

This invention discoses a method for the injection of molten metal into a die casting die in an optimum time frame based on the solidification pattern 19 of FIG. 1 and the lower graph in FIG. 2, not necessarily from the inventor's copyrighted program, for an alloy wall thickness of 2d with a given die temperature $u_{si}$ and a given molten metal pouring temperature u*al*. More particularly this invention relates to die casting dies and machines equipped with means to provide the key process temperature parameters to a computer loaded with the preferred computer software program 18. The key process variable inputs to the preferred software program 18 along with the stored alloy and die thermal properties permits the preferred computer software program 18 to calculate the inventor's equations and produce the graph 19 of FIG. 1 and the lower graph of FIG. 2, i.e. Isoclines, the alloy solidification pattern. The die casting process is improved when the Isoclines of graph 19 FIG. 1 or the lower graph in FIG. 2 are utilized to establish the cavity fill time observed in the upper graph of FIG. 2, which is a recording of the output of a pressure transducer 16, of FIG. 1, located in the hydraulic injection cylinder 15. The computer software also uses stored thermal properties and the key process parameters to calculate the quantity of heat diffused to the die by the alloy as it cools to the dynamic solidus as in FIG. 3. A determined quantity of heat diffused can be used for setting the cavity fill time. For example setting the fill time to 75% of the total heat diffused to the dynamic solidus in FIG. 3 is approximately 0.75 seconds i.e. the cavity should be filled in roughly 0.75 seconds for the magnesium alloy AZ91 B, whose wall thickness 2d=0.250 in., the die temperature $u_{si}$=486° F. and the alloy pouring temperature $u_{ai}$=1210° F., i.e. the conditions of FIG. 3.

The wall chosen for temperature measurement in controlling the injection parameters will probably have something difficult or unusual about it. The wall could be the thinnest in the casting, or it could be a long distance from the entry point of the gate to the casting. Or it could simply be one of the locations representing the standard wall of the casting, but is expected to be a particularly cool part of the die or a difficult section of the casting to fill. It could, however, be the heaviest wall of the casting.

For an understanding of this invention, which applies the mathematics and physics of the inventor to affect a method improvement in die casting, a discussion is necessary, presenting the equations, explaining the parameters, explaining where the parameters emanate and describing generally the software and the computer used to solve the equations.

The computer 18 in FIG. 1. is any one of a number of well-known computers, which has any of a number of operating systems. These commercial computers are fast cycling and contain considerable storage capacity, both RAM and ROM. The computer 18 has a software program loaded that contains natural logarithm functions, trigonometric functions, is able to perform the operations required by the inventor's equations and is programmable for iteration of the inventor's equations. The thermal properties of the alloy to be cast, as well as the thermal properties of the die material, most likely H13 die steel, are stored in the preferred computer software program 18.

One solution to the transient heat flow problems of the type found in the solidification of alloys in a die casting die is arrived at through an infinite series of sines and cosines called a Fourier Series Analysis. In 1998 the inventor formulated simultaneous Fourier series equations for temperature vs. time at any depth in the alloy and the die material with these equations converging at the boundary. As developed in the inventor's copyrighted treatise on the solidification of metals in a die casting die and stored in the preferred computer software program 18, not necessarily the inventor's copyrighted software program Isoclines©, these equations are:

Equation A. The Isoclines equation for the temperature $u_a$(x<=d, t) in an alloy wall of thickness 2d at depth x as a function of time is:

$$u_a(x<=d,t)=u_b+4/\pi*\{(u_{ai}-u_l)*\sum((-1)^n/(2*n+1))*\mathrm{EXP}(-(((k_{st}/(c_{pliq}*\rho a))^{.5}*(2*n+1)*\pi/(2*d))\wedge 2*t))*\mathrm{COS}(((2*n+1)*\pi*x)/(2*d))+(u_l-u_b)*\sum((-1)^n/(2*n+1))*\mathrm{EXP}(-(((k_{st}/(c_{pls}*\rho a))^{.5}*(2*n+1)\cdot\pi/(2*d))\wedge 2*t))*\mathrm{COS}(((2*n+1)*\pi*x)/(2*d))\},$$

where, $u_a$(x<=d,t)=the temperature of the solidifying die cast alloy as a function of depth & time and when the entire spectrum is presented in graph form are the Isoclines 18 of FIG. 1, and in Equation A, x=the distance from center of the alloy wall, equal to or less than d, d=the half-thickness of alloy wall manually stored in the software program 18, and x is varied from 0 to d in iterating t, the time, by running the software program 18, where, $u_{ai}$=initial metal temperature or pouring temperature of the molten alloy, and is entered into the software program 18 manually or from a thermocouple (not shown) located in the path of the metal poured into the pouring hole 11 of FIG. 1, where the following are from data stored in the computer software program 18, $u_l$=the classical liquidus temperature of die cast molten alloy, $k_{st}$=the conductivity of the die material as a function of temperature, $C_{pls}$=the specific heat of the liquidus-solidus molten alloy i.e. the heat of fusion per degree.

$C_{pliq}$=the specific heat of the liquidus molten alloy.

$\rho_a$=the density of the molten alloy.

$\pi$=3.1416,

Exp(n)=the base $e^n$ or $2.71828182845904^n$,

Cos=the trigonometric cosine, where,

Σ=summation from 0 to n and, where, $u_b$(t)=the interface boundary temperature 19 in FIG. 1 and noted in FIG. 2, between the alloy surface and the die material surface as a function of time, that is $u_b$(t) in Equation A is either from calculations of $u_b$(t), Equation C below, or is the digitized data from the die surface mounted thermocouple 7 for use as $u_b$(t) and or storage in the preferred software 18 from 0 to a time greater than the dynamic solidus occurrence.

Equation B. The equation for the transient temperature $u_s$(d=<x<l, t) in the die material cooling the wall of the casting is:

$$u_s(d=<x<l,t)=u_b+4*(u_{si}-u_b)/\pi*\Sigma(1/(2n+1))*\mathrm{EXP}(-((\alpha_{st}*(2*n+1)*\pi/(2*l))\hat{}2*t))*\mathrm{SIN}(((2*n+1)*\pi*(x_s-d))/(2*l)),$$

that is $u_s$(d=<x<l,t)=the temperature of die material as a function of depth & time, represented by cooling lines i.e. Isoclines (not shown) of constant depth in the die material calculated in the software program 18, where, $x_s$=depth in die material equal to or greater than d as referenced from the center of the alloy wall, l=thickness of die material>20 times d, and $x_s$ is varied from d to l in iterating t by operation of the software program 18, with the thickness of the die material l=>20 times d so that I will not to be a factor in the equations during the fill time, where, $u_{st}$=initial surface temperature of die at t=0, can be entered manually into the software program or be obtained from the surface mounted thermocouple 7 or from a contact or optical pyrometer not illustrated, where the following are from data stored in the computer software program 18, $\alpha_{st}=(k_{st}/(c_{st}*\rho_{st}))^{1/2}$=the diffusivity of the die material, a function of temperature, $c_{st}$=the specific heat of the die material as a function of temperature.

$\rho_{st}$=the density of the die material as a function of temperature.

Sin=the trigonometric sine, where,

Σ=summation from 0 to n and, where, $u_b(t)$=the interface boundary temperature between the alloy surface and the die material surface as a function of time as described for Equation A above, Equation C: The equation for the temperature $u_b(t)$ at the boundary, noted in 19 of FIG., 1 and noted in FIG. 2, between the solidifying alloy and the die material as a function of time is:

$$u_b(t) = \left(2*(u_{ai}-u_l)*k_a/d*\sum \mathrm{Exp}\left(-\lambda_{al}^{liq}\wedge 2*t\right)+2*u_l*k_a/d*\sum \mathrm{Exp}(-\lambda_{al}^{ls}\wedge 2*t)+2*u_{si}*k_{st}/l*\sum \mathrm{Exp}(-\lambda_{st}\wedge 2*t)\right)/\left(2*k_{st}/l*\sum \mathrm{Exp}(-\lambda_{st}\wedge 2*t)+2*k_a/d*\sum \mathrm{Exp}(-\lambda_{al}^{ls}\wedge 2*t)\right)$$

where:

$$\lambda_{al}=\alpha_{al}^{liq}*(2*n+1)*\pi/(2*d) \text{ and, } \alpha_{al}^{liq}=(k_{st}/c_{cp}^{liq}*\rho_{al})^{1/2}$$

and, $$\lambda_{al}=\alpha_{al}^{ls}*(2*n+1)*\pi/(2*d) \text{ and, } \alpha_{al}^{ls}=(k_{st}/c_{cp}^{ls}*\rho_{al})^{1/2}$$

and, $$\lambda_{st}=\alpha_{st}*(2*n+1)*\pi/(2*d) \text{ and, } \alpha_{st}=(k_{st}/(c_{st}*\rho_{st}))^{1/2}$$

Equation C for $u_b(t)$ can be used to obtain the thermal property of alloy conductivity $k_a$ above the solidus. Examination of the equation shows the parameters $u_{ai}$, $u_l$ and $u_{si}$ may be considered mathematical "givens" in one manner or another, while the thermal properties of the most commonly used die material, H-13, are known through 1400° F. and stored in the computer 18. The alloy density can be assumed constant for the mass of the wall section which can not change through cooling for the mass at room temperature will be the mass at any temperature. The heat of fusion of the alloy is known for all of the common die casting alloys and the term $(k_{st}/c_p^{ls}*\rho_{al})^{1/2}$, a function of the heat of fusion can thus be determined. The term $(k_{st}/c_p^{liq}*\rho_{al})^{1/2}$ is a function of the superheat i.e. the heat above the liquidus temperature of the alloy and its value is greatly overshadowed by the much larger heat of fusion term. A reasonable assumption therefore for the superheat term of the specific heat property will provide all of the variables to give excellent results for $k_a$ at any temperature.

The alloy thermal conductivity $k_a$ can thus be determined by calculating $u_b(t)$ with the computer software program 18 while varying $k_a$ to fit a calculated plot of $u_b(t)$ to a graph of the boundary temperature $u_b(t)$ data from the alloy-die surface thermocouple 7 using the same alloy pouring temperature $u_{ai}$ and the same initial die temperature $u_{si}$ for both plots.

The quantity of heat transferred to the die material in time t is given by the integral expression:

$$Q=-k_a\int_0^t \partial u_a/\partial x\, dt,$$

where $k_a$ is the thermal conductivity of the injected metal alloy. Integrating this equation after substituting the derivative of $u_a$ with respect to x the following expression is obtained:

$$Q=2*k_a/d\left\{(u_a-u_l)*\left[\sum \frac{e-\lambda_l^2*t}{-\lambda_l^2}-\sum \frac{1}{-\lambda_l^2}\right]+(u_l-u_b)*\left[\sum \frac{e-\lambda_{ls}^2*t}{-\lambda_{ls}^2}-\sum \frac{1}{-\lambda_{ls}^2}\right]\right\}. \quad \text{Equation D}$$

where: $\lambda_l=(k_{st}/(c_{pliq}*\rho_a))^{0.5}*(2*n+1)*\pi/(2*d)$ and, $\lambda_{ls}=(k_{st}/(c_{pls}*\rho_a))^{0.5}2*n+1)*\pi/(2*d)$ A computer calculated plot of Equation D i.e. the quantity of heat Q(t) flowed to the die as a function of time is shown in FIG. 3 for a ¼ inch wall of magnesium alloy AZ91. The initial die temperature and the alloy pouring temperature are shown in the lower right side of FIG. 3 as 486° F. and 1219° F. respectively. Subtracting Q(t) from the total heat above the dynamic solidus provides the heat remaining in the casting wall above the dynamic solidus. The heat remaining in the wall as a per cent of the total heat is plotted in the graph as well.

In summary Equations A, for $u_a(x<=d,t)$, Equation B, for $u_s(d=<x<l,t)$, Equation C, for $u_b(t)$, and Equation D, for Q(t) can be calculated using the thermal properties of the alloy and die material stored in the computer and the previously determined/measured and stored operating parameters: the alloy pouring temperature, $u_{ai}$, the initial die temperature, $u_{si}$, and the alloy wall thickness, 2d. Using the transient thermocouple boundary temperature data for the value of $u_b(t)$ in Equations A, B, and D, the accuracy of $u_a(x<=d,t)$, the Isoclines for the solidification pattern in the casting wall, the accuracy of $u_s(d=<x<l,t)$, the Isoclines for the temperature in the die material, and the accuracy of Q(t), the heat flow from the casting wall to the die as a function of time, are improved.

In the preferred method of employing the present invention there is provided a thermocouple 7 mounted flush with the ejector die surface 8 to measure the alloy-die boundary temperature $u_b(t)$, i.e. the casting surface, and the hydraulic injection cylinder 15 of a die casting machine has a pressure transducer 16 to measure the pressure during the alloy injection phase. The die surface mounted analog thermocouple's 7 function in the invention is to output the initial die temperature $u_{si}$ and also the transient alloy-die boundary temperature $u_b(t)$ during injection of the alloy, to a commercially available multi-channel analog to digital converter (A/D) 17. This A/D converter 17 can be a separate unit as shown or it can be an adapter card in the computer. The digitized thermocouple data from the A/D converter is thence entered as $u_{si}$ and $u_b(t)$ in the preferred computer software program 18 for storage and subsequent use in the mathematical Equations A, B, and D when requested. The preferred computer software program 18 then iterates calculated data for a graph of the temperature $u_a(x=<d, t)$ in the casting wall as a function of time and depth, as in FIG. 2 and the quantity of heat remaining data for the graph of FIG. 3. Equation B for $u_s(d=<x<l,t)$, can be iterated from the thermocouple boundary data but is not necessary for control of the injection process.

Similarly in the preferred technique the pressure transducer 16 mounted in the hydraulic cylinder 15 outputs data for the hydraulic injection pressure signal to another channel of the analog to digital converter (A/D) 17. The digitized pressure transducer data is then entered into the preferred computer software program 18 to produce a second graph, a typical hydrauliscope pressure vs. time plot of the injection cylinder pressure, the upper graph in FIG. 2.

Thus the operation of the preferred computer software program and the related apparatus is as follows. Commercially available A/D converters have a threshold feature used to trigger the flow of digitized data. When incoming metal strikes the thermocouple a sharp rise in temperature occurs indicating the commencement of heat transfer to the die i.e. the beginning of the solidification process. This temperature rise of the thermocouple 7 and the injection pressure rise detected by the injection cylinder transducer 16 are literally simultaneous and both occur at time $0+\Delta t$ in the Upper and Lower graphs in FIG. 2. Either the temperature rise detected by thermocouple 7 or the rise in injection pressure detected by the pressure transducer 16, can be used to trigger the flow of A/D 17 data into the computer 18. The preferred method of triggering the flow of data from the A/D 17 converter is a predetermined pressure rise of some magnitude, for example an increase of 400 psi. from the earlier low resistance pressure would be the trigger point.

The Alloy-Die Temperature Boundary in graph 19 FIG. 1 and the bottom graph in FIG. 2. reveals an initial interval of constant temperature indicating very little, if any, solid metal alloy has formed other than possibly immediately adjacent the die surface and the metal is in a highly fluid state at this plateau. Decaying from this initial plateau, convergence of Isoclines in the graph 19 of the thermocouple data or a second plateau will indicate the end of solidification i.e. the dynamic solidus time, abbreviated DST. Very thin casting walls tend to obscure a plateau for the dynamic solidus necessitating the use of the Isoclines convergence to identify the end of solidification. Satisfying a criteria for the convergence i.e. the rate of change of temperature with depth of Isoclines or the repetition of input data signifying the dynamic solidus plateau signals the end of solidification. Filling for optimum quality must occur in a time frame less than that indicated by this end of solidification. Some fraction of the time to reach the end of solidification thus calculated by the computer 18 is used in setting the fill time. Visual determinations of the end of solidification from the Isoclines of FIG. 2 used for setting the fill time are within the scope of this invention.

Since there is a pronounced rise in the hydraulic injection pressure at the instant molten metal reaches the restricted gate entrance to the casting this pressure rise triggers the threshold of the A/D converter signifying the commencement of the fill time. The cessation of cavity filling identifies itself by the sudden stoppage of the injection cylinder piston and the metal plunger whereby the kinetic energy is converted to a sharp rise in the pressure followed by a damped oscillation during the absorption of that energy. The fill time is simply the time of this second sharp pressure rise due to the stoppage of the injection cylinder piston since t=0 at the instant of the first rise signaling metal started flowing into the cavity. This actual fill time is then stored in the preferred computer software program.

An acceptable fill time will certainly be considerably longer than the duration of the liquidus plateau and less than some fraction of the time to reach the solidus plateau of Isoclines. Thus the DST for control purposes will be established by the difference between the time of the A/D trigger t=0 and the decided fraction of the time to reach the solidus plateau. It is apparent therefore the DST will be used in a subsequent casting cycle for the maximum time to fill the cavity. There is however a cyclic stability in a process under control and as such if either the DST or the fill time are out of established ranges the software will indicate an exception has occurred. Correction can be somewhat automatic by adjustment of the flow through the valve (not shown) or valves controlling the injection cylinder. Today's modern die casting injection systems have numerous options for controlling the speed of injection including the magnitude of the injection pressure as well as creating a back pressure in the injection cylinder 15 by restricting the exhaust of fluid from the return side of the injection cylinder.

The lower Isoclines graph in FIG. 2 and the quantity of heat remaining graph Q(t) of FIG. 3 are for the same alloy, magnesium AZ91, and conditions. It will be noted that the 0.240 seconds for filling the cavity in the upper pressure vs. time graph of FIG. 2 is almost entirely within the first plateau of the boundary of the Isoclines graph below. This first plateau is the dynamic liquidus during which the metal is highly fluid and therefore there could be a tendency for the die to "spit" during injection with this fill time.

On the basis of the Isoclines of FIG. 2 and the heat remaining graph of FIG. 3 the limits on the fill time for this example should be set at 0.743 seconds maximum and 0.495 seconds minimum. This is an unusually broad range and is the result of the exceptionally thick wall in magnesium of 0.250 inches. A more normal wall for magnesium die castings of ⅛ inch, cast under the same conditions and using the same criteria for the limits results in a maximum and minimum fill time of 0.170 to 0.113 seconds.

Multiple selection of locations in the die of different wall thickness and different initial die temperatures for placing thermocouples and determining several graphs of Isoclines to be selected alternately or in combination for controlling the fill time are within the scope of this invention.

Readily available thermocouples 7 or in-wall temperature measuring probes have exceptionally fast responses on the order of 10 microseconds for transient temperatures and can be made of any metal, thus matching the diffusivity of the die material, minimizing error.

The purpose of an intensifier is to overcome the increasing viscosity of the solidifying metal and increase the density of the casting by displacing a final incremental volume of alloy in the metal sleeve 12 to satisfy the solidification shrinkage in the casting. The intensifier excitation is triggered most often by a fixed relation to the known position of the shot cylinder where the cavity is filled. For example excitation of the intensifier might be excited at a distance of 0.75 inches from the position at which the cylinder is stopped by resistance of a full cavity. Because the excitation of the intensifier is generally a position relationship like that described varying the injection speed plus or minus fairly automatically varies the time of excitation for the intensifier. In the simplest case this is accomplished by a limit switch tripped at the predetermined distance from the end of the travel of the injection cylinder. Due to the fact of the high pressure, low displacement attributes of intensifiers they generally will not cause a pressure rise above the normal injection pressure of the cylinder piston until the resistance caused by the filled cavity occurs. At the cavity filled point intensifiers fluid displacement permits the normal injection pressure to be multiplied by factors on the order of 4 times.

Magnesium die castings generally do not benefit from intensification as greatly as aluminum castings. For this reason and for clarity an injection pressure vs. time graph showing the application of an intensification pressure has not been shown.

Conversely the end of cavity filling time can be used to locate the quantity of heat remaining in the alloy above the dynamic solidus from its graph in FIG. 3. The upper graph in FIG. 2 shows the cavity is filled in 0.24 seconds followed by the pressure oscillation damping the kinetic energy of the injection system. At 0.24 seconds in FIG. 3 it can be seen that 40% of the heat in the alloy above the dynamic solidus has been transferred to the die material. A determination therefore can be made from FIG. 3 whether filling has occurred either too fast or too slow based on the amount of heat remaining, which in this case is too fast. Rarely should the cavity be filled faster than is required for 50% of the heat to be removed from the casting wall, as the specified thermocouple 7 location would generally be for the thinnest wall. Also the maximum fill time should generally be no more than for 75% of the wall heat to be removed.

Having described the function of the inventor's equations and mathematics for the control of the injection speed and the intensification the sequence of the process will be presented step by step.

A normal cycle of the die and machine of FIG. 1 per the process disclosed is as follows. Starting in a closed die position metal from a holding furnace, not shown, is poured into the pouring hole 11 in the top of the horizontally positioned metal sleeve 12 by either manual or automatic means. At this time the pouring temperature $u_{ai}$ must be entered into the computer software program 18 for storage. The source of $u_{ai}$ can be the holding furnace temperature thermocouple controlling the temperature of the metal in the furnace, a thermocouple in the path of the molten metal entering the pouring hole 11 or it can simply be stored in the computer software 18 manually. From a calculation of the equation's standpoint $u_{ai}$ is not critical and in most cases if it is within 20° F. an accurate set of Isoclines will be determined i.e. less than a 2% error in the DST. However, the cumulative affect of a pouring temperature error either high or low can result in the desired die temperature going out of control which can be critical. This is beyond the scope of this invention and deals with other process controls. Immediately on completion of the pouring the injection cylinder 15 in FIG. 1, is actuated thereby advancing the injection assembly consisting of the crosshead 17, the plunger rod 14, and the plunger 13 at a relatively slow speed horizontally down the metal sleeve 12 until metal in the gate runner (not shown) encounters an orifice entrance to the die cavity. During the interval commencing with the closing of the casting machine and the moment the metal strikes the orifice entrance to the die cavity the initial die surface temperature $u_{si}$ must be recorded in the computer software. The input of $u_{si}$ can be from a pyrometer reading either contact or optical type taken just before the machine closes or from a reading of the ejector die surface thermocouple 7 initiated simultaneous with the initiation of the injection phase or at any time after but prior to the pressure rise associated with the entrance of metal into the die cavity. The magnitude of error in the DST from a 20° F. variance in $u_{si}$ is the same error as for equal variance in $u_{al}$ or 2%. The thermocouple 7 could equally well have been located in the cover die. The die cavity is formed by the cover die 10 attached to the stationary machine platen 9, and the ejector die 8 attached to the movable platen 5 through an ejector box 6.

Note at t=0 in the upper half of FIG. 2, the pressure rise occurring in 0.015 seconds from the increased resistance to movement of the injection system from the additional force necessary to drive metal through the gate orifice entrance to the die cavity. Again this pressure rise is the preferred trigger of the A/D converter for the commencement of storage in the computer software program 18 of both the thermocouple 7 data for $u_b(t)$ the Alloy-Die Temperature Boundary noted in the lower graph of FIG. 2, and the pressure on the injection cylinder detected by the pressure transducer 16 for the upper graph of FIG. 2. High quality rugged ceramic transducers 16, able to accurately detect and transmit pressure variations, are available from numerous producers. In this example the pressure rise to 850 psi. fills the cavity in 0.24 seconds a questionable fill time. In addition to the ingate orifice restriction causing the first pressure rise in the injection cylinder this is the point at which a valve (not shown) is caused to shift causing the plunger 13 of FIG. 1. to advance more rapidly and this is referred to as the fast shot phase. There are many variations in the initiation of the fast shot including one that occurs after the plunger 13 passes the pouring hole 11.

At virtually an instant after the fast shot commences molten metal in the cavity contacts the thermocouple 7 of FIG. 1 causing it to record a rise in the die surface temperature from the initial die temperature $u_{si}$ of 486° F. in this example to approximately 872° F. per the Isoclines plot in the lower half of FIG. 2 at t=0.015 seconds approximately. Alternatively this rise in the die surface temperature can be used by the A/D converter 17 to begin the flow of data to the computer software program 18 from the thermocouple 7 and the pressure transducer 16. The signals from the thermocouple 7 and the pressure transducer 16 are converted to digital by the A/D converter 17 for storage and processing by the digital computer 18 beginning at t=0 in FIG. 2. The entire Alloy-Die Boundary Temperature in the lower graph in FIG. 2 i.e. $u_b(t)$, can be obtained from the thermocouple 7 data. Note that the hydrauliscope recording in the upper graph of FIG. 2 is not a complete graph of the pressure during the injection phase but only a graph that commences virtually simultaneous with the initial rise of temperature "seen", by the thermocouple 7. In otherwords this recording in the upper half of FIG. 2 omits several pressure changes which occur with the initiation of pressure into the injection cylider. The sharp rise in the pressure in the upper graph of FIG. 2 at 0.240 seconds signals the cavity had been filled and because the recording commenced with the start of filling as triggered by the rise in pressure when metal first struck the ingate to the cavity, the "fill time" can be read directly and in this instance is 0.240 seconds. These signals to the A/D converter 17 are continuous and the digital outputs can be generated with any frequency necessary to produce accurate smooth graphs. At the 872° F. and t=0.015 seconds approximately the rise in the die surface temperature finds equilibrium with the alloy surface temperature also 872° F. (down from the pouring temperature of 1210° F.) which is the dynamic liquidus for the alloy. From this point mathematically this boundary is $u_b(t)$ of the inventor's equations.

As an alternative, the initial pouring temperature $u_{ai}$, the initial die temperature $u_{si}$ and the wall thickness 2d stored in the computer and the alloy and thermal properties stored in the computer can be used to calculate the alloy die boundary from Equation C for $u_b(t)$.

The digitized analog data from the A/D converter 17 is entered into the digital computer 18 for storage. Commercial analog to digital A/D converters 17 are available as part of signal conditioning modules that have software drivers for data entry in the common programming languages. These modules permit hot link data entry directly into the software 18 without previous storage. It is literally a plug and play effort with state of the art signal conditioners to enter the data from the thermocouple 7 and the transducer 16 into the computer software program. This is accomplished by attaching the thermocouple 7 and the transducer 16 to the terminal block of the module containing the A/D converter and attaching the module to the serial port of the computer 18.

Moore's law states that computer CPU speed will double every 2 years. Today's well known and readily available computers 18 permit the calculation and graphing of Isoclines $u_a(x,t)$ on a real time basis such that the last cycles data can be reflected in this cycles performance without storage independent of the software program. Data storage directly in the program is thus possible and desirable.

Several events surrounding the incidence of the cavity filled time can signal the computer to commence calculation of the Isoclines for the alloy and die as well as the heat remaining calculation. The first is a time interval after the pressure rise signaling the end of the cavity filling. Second a temperature to which the Alloy-Die Boundary has fallen. The preferred method is to commence the calculations when the data for the boundary falls below a given temperature for example in this case that temperature could be 700° F. It can be shown readily by the boundary plot that this occurs in less than 1 second after the dynamic solidus is reached. It should be noted that if a boundary is calculated from Equation C the calculations can be started literally with the closing of the die and ladling of the metal for data necessary from the die is available through an optical or contact pyrometer at that time. Additionally an optical or contact pyrometer method has the distinct advantage of flexibility in selecting a location.

At the conclusion of a predetermined set time, started when the injection cylinder travel has ceased, ranging from several seconds for very small castings to 30 seconds or more for large castings a valve (not shown) controlling the hydraulic closing cylinder 1 will be actuated. During this set time the preferred computer software program will be running. Subsequently the computer monitor will display FIG. 2 or FIG. 3 and the data table for the spectrum of Isoclines is given a file name and stored and/or the graphs of that data as in FIG. 2 and FIG. 3 may be stored. Following the expiration of the set time the hydraulic closing cylinder 1, mounted on the rear stationary platen 2, collapses the links 3 and 4 opening the casting machine. When the movable platen 5 comes to rest the casting is ejected from the die by a cylinder in the ejector box 6. Following the ejection of the casting from the die, the cavity surface is sprayed with a lubricant, the excess blown off, the machine is then closed, being ready for another cycle.

The process as disclosed above in a die casting machine with the die parting plane horizontal and whose axis is vertical, opening and closing along said axis is entirely within the scope of this invention.

It is state of the art for transducers also to be positioned in the backpressure side of the injection cylinder 15 that can be used to indicate the time in which the cavity has been filled. It is state of the art for pressure transducers to be mounted at various locations in the die casting die surface for detection of the cavity fill time and a signal from said transducer converted for use in the preferred computer software program 18 or otherwise for comparison with Isoclines and such detections used for control of the fill time are within the scope of this invention.

Die casting dies with a plurality of die members movable in the parting plane and/or which have members movable obliquely to the parting plane containing a surface mounted thermocouple in these auxiliary die members that inputs data from that thermocouple to a computer software program for the purpose of comparison with Isoclines $u_a(x<=d, t)$ for validation of the fill time are within the scope of this invention.

Various modifications of the above-described embodiment will be apparent to those skilled in the art for accomplishing the same object. It is to be understood that such modifications can be made without departing from the spirit and scope of the invention, which should be limited only by the following claims.

What I claim is:

1. A method of improving a pressure die casting process by controlling an injection phase of an operation of a die casting machine through application of equations derived by equating a heat flow from an injected solidifying alloy wall to heat entering a die material, said derived equations are for calculating temperature vs. time at varying depths in a solidifying alloy wall, for calculating temperature vs. time at varying depths in a die, for calculating temperature vs. time at a boundary surface between the alloy wall and the die, and for calculating a quantity of heat transferred from the alloy to the die vs. time, with said equations used to determine a maximum and minimum for a fill time for injection of metal into a cavity by using a computer software program to calculate said equations for determining a solidification progression or solidification pattern, Isoclines, thereby determining a dynamic liquidus plateau and a dynamic solidus plateau from said solidification progression pattern or boundary in a selected wall of a casting and calculating an amount of heat remaining in said wall above the dynamic solidus, where said wall is formed by a stationary cover die and an ejector die assembly which define the cavity therebetween when a die is in its closed position, with at least one of said die members having a die surface mounted thermocouple means at the selected wall to output a signal or data on a transient boundary temperature $u_b(t)$ between an injected alloy wall surface and a contacted die surface as a function of time, the transient boundary temperature being uniquely defined by three casting parameters or variables of said equations; an initial temperature of an injected molten alloy $u_{ai}$, an initial die surface temperature, $u_{si}$, and an alloy wall thickness of 2 times d at the selected wall location; with said transient boundary thermocouple temperature signal output occurring for at least a time interval for a molten alloy to solidify and using a means to convert this thermocouple signal of the boundary temperature to digital data for storage in said computer software program and using a means to prepare said data for entry into said software program, with this data subsequently being used as the value for $u_b(t)$, and whereby a thermocouple in a path of molten metal poured into a metal injection sleeve is used to detect and store in said computer program an initial molten metal temperature as a value of ua in said equations and where at least one wall thickness of 2 times d at a location of a boundary surface thermocouple is manually entered and stored in said software program to provide a value d, and there is a set of alloy thermal properties consisting of specific heats, an alloy density, and an alloy thermal conductivity, and a set of die material thermal properties, consisting of specific heat, density and conductivity stored in said computer software program, whereby said thermal properties of the alloy and the die material and values for three variables, $u_b(t)$, $u_{ai}$ and d, all are used for calculating and plotting the injected alloy solidification pattern $u_a(x<=d,t)$, a temperature versus time graph for varying depths in a casting wall, Isoclines, using the equation, $$u_a(x<=d,t)=u_b+4/\pi*\{(u_{ai}-u_l)*\sum((-1)^n/(2*n+1))*\mathrm{EXP}(-(((k_{st}/(c_{pliq}*\rho a))^{.5}*(2*n+1)*\pi/(2*d))\wedge 2*t))*\mathrm{COS}(((2*n+1)*\pi*x)/(2*d))+(u_l-u_b)*\sum((-1)^n/(2*n+1))*\mathrm{EXP}(-(((k_{st}/(c_{pls}*\rho a))^{.5}*(2*n+1)\cdot\pi/(2*d))\wedge 2*t))*\mathrm{COS}(((2*n+1)*\pi*x)/(2*d))\}.$$

where:

t=time x=distance from a center line of alloy wall equal to or less than d, $u_a(x<=d, t)$=calculated temperature of an injected alloy as a function of depth & time, $u_{ai}$=metal temperature (initial) or alloy pouring temperature of the molten alloy, $u_l$=liquidus temperature of the molten alloy, $u_b(t)$=boundary temperature or alloy-die surface temperature as a function of time determined by the thermocouple, d=half-thickness of an alloy wall of 2 times d, $k_{st}$=die material thermal conductivity, $c_{pls}$=liquidus-solidus molten alloy specific heat $c_{pliq}$=liquidus molten alloy specific heat, $\rho_a$ molten alloy density, $\pi$=3.1416, Exp(n)=base $e^n$ or $2.71828182845904^n$, $\Sigma$=summation from 0 to n and, Cos=trigonometric cosine, and for calculating and plotting a set of heating lines in a die material using the equation, $$u_s(d=<x<l,t)=u_b+4*(u_{st}-u_b)/\pi*\Sigma(1/(2n+1))*\mathrm{EXP}(-((\alpha_{st}*(2*n+1)*\pi/(2*l))\hat{}2*t))*SIN(((2*n+1)*\pi*(x_s-d))/(2*l))$$

where:

$x_s$=a depth in a die material equal to or greater than d, $u_s(d=<x<l, t)$=temperature of die material as a function of depth & time, $u_{st}$=temperature (initial) of die at t=0, $\alpha_{st}=k_{st}/(c_{st}*\rho_{st})$=die material diffusivity, $c_{st}$=die material specific heat, $\rho_{st}$=die material density, l=a thickness of die material>20×d, Sin=trigonometric sine.

and calculating an amount of heat remaining above the dynamic solidus temperature, using the equation, $$Q(t)=2*k_a/d\left\{(u_{ai}-u_l)*\left[\sum\frac{e-\lambda_l^2*t}{-\lambda_l^2}-\sum\frac{1}{-\lambda_l^2}\right]+(u_l-u_b)*\left[\sum\frac{e-\lambda_{ls}^2*t}{-\lambda_{ls}^2}-\sum\frac{1}{-\lambda_{ls}^2}\right]\right\}$$

-continued where:

$$\lambda_l=(k_{st}/(c_{pliq}*\rho_a))^{0.5}*(2*n+1)*\pi(2*d)$$

and, $$\lambda_{ls}=(k_{st}/(c_{pls}*\rho_a))^{0.05}*(2*n+1)*\pi(2*d) \text{ or}$$

with said solidification pattern and heat calculations Q(t) being used for establishing the maximum and minimum limit for the fill time and whereby for comparison purposes with that fill time a pressure transducer means is provided in a die casting die or in a die casting machine injection cylinder for detection of an injection pressure whereupon a pressure signal is converted to digital data for entry and storage in said software program and this pressure data is used by the computer program to plot an injection pressure-time graph for fill time, with said fill time to be controlled and set for the selected cavity wall location automatically for a next cycle by said computer program within the Isoclines determination of the dynamic solidus and the dynamic liquidus, thereby setting limits for the maximum and minimum fill time and/or by using the heat calculation Q(t) for establishing a time range within which the fill time is to be controlled and set.

2. The pressure die casting process described in claim 1 wherein a die contains a plurality of movable members to form a cavity and one or more auxiliary movable die members having a surface mounted thermocouple means to output a temperature of a boundary between an alloy surface and a contacted die surface as a function of time during an interval for an injected molten alloy to solidify, using a means to convert and prepare this signal of the boundary temperature to digital data for entry and storage in said software program, with said data subsequently being used as a value $u_b(t)$ in said computer software program for calculating the solidification pattern as in claim 1 and calculating an amount of heat, Q(t), remaining above a dynamic solidus as in claim 1 with said solidification pattern and heat calculations being used for establishing the maximum and minimum for the fill time and using a means provided in said die casting die or in said machine injection cylinder for detection of an injection pressure whereupon a pressure signal created by a pressure detection device is used by said computer program for plotting an injection pressure-time graph for fill time for a movable member wall location, with said fill time to be controlled and set automatically for a next cycle by said computer program within Isoclines determination of the dynamic solidus and the dynamic liquidus thereby setting limits for the maximum and minimum fill time and/or by using the heat calculation for, Q(t), for establishing the time range within which the fill time is to be controlled and set as in claim 1.

3. The pressure die casting process described in claim 1 wherein a die casting machine contains a means for intensification of an injection pressure, whereupon a time of actuation of said intensification means and a control and setting of fill time for a next cycle is automatic by said computer program within the Isoclines determination of the dynamic solidus and the dynamic liquidus thereby setting limits for the maximum and minimum fill time and/or using the heat calculation, Q(t), for establishing the time range within which the fill time is to be controlled and set as in claim 1.

4. The pressure die casting process described in claim 1 wherein a die casting machine contains a means for intensification of injection pressure, a casting die with a plurality of die members to form a cavity and one or more auxiliary movable die members having a die surface thermocouple to determine Alloy-Die Temperature Boundary $u_b(t)$, with value/s of $u_b(t)$ used by the computer software program as in claim 1, and means for detection of a time of actuation of an intensifier and detection of fill time to be used in said computer software program as in claim 1, wherein said computer software program determines and automatically sets a timing for an actuation of the intensifier as well as control and setting of fill time for a next cycle as in claim 1.

5. A method of improving the die casting process by determining a thermal conductivity, $k_a$, of die cast metals at elevated temperatures for use in an equation for heat conduction, Q(t), that establishes a time range for setting and controlling a fill time, wherein $k_a$ is determined in a computer software program by varying $k_a$ in a calculated plot of an equation for a boundary surface, $u_b(t)$, between the solidifying metal and the die, to fit an Isoclines boundary plot of data from a die surface-mounted thermocouple, where the equation for a boundary of the calculated plot is, $$u_b = \left(2*(u_{ai}-u_l)*k_a/d*\sum \mathrm{Exp}\left(-\lambda_{al}^{liq}\wedge 2*t\right)+2*u_l*k_a/d*\sum \mathrm{Exp}(-\lambda_{al}^{ls}\wedge 2*t)+2*u_{si}*k_{st}/l*\sum \mathrm{Exp}(-\lambda_{st}\wedge 2*t)\right)\Big/\left(2*k_{st}/l*\sum \mathrm{Exp}(-\lambda_{st}\wedge 2*t)+2*k_a/d*\sum \mathrm{Exp}(-\lambda_{al}^{ls}\wedge 2*t)\right)$$

where:

$u_b(t)$=boundary temperature or alloy-die surface temperature as a function of time, t=time $u_{ai}$=metal temperature (initial) or alloy pouring temperature of the molten alloy, $u_l$=liquidus temperature of the molten alloy, $u_{si}$=temperature (initial) of die at t=0, $c_{pls}$=liquidus-solidus molten alloy specific heat $c_{pliq}$=liquidus molten alloy specific heat, $\rho_a$=molten alloy density, d=the half-thickness of an alloy wall of 2 times d, $k_{st}$=die material thermal conductivity, $c_{st}$=die material specific heat, $\rho_{st}$=die material density, l=a thickness of die material >20×d,

π=3.1416,

Exp(n)=base $e^n$ or $2.71828182845904^n$,

Σ=summation from 0 to n and, where:

$$\lambda_{al}^{liq}=\alpha_{al}^{liq}*(2*n+1)*\pi/(2*d) \text{ and, } \alpha_{al}^{liq}=(k_{st}/c_{pliq}*\rho_a)^{1/2}$$

and, $$\lambda_{al}^{ls}=\alpha_{al}^{ls}*(2*n+1)*\pi/(2*d) \text{ and, } \alpha_{al}^{ls}=(k_{st}/c_{pls}*\rho_a)^{1/2}$$

and, $$\lambda_{st}=\alpha_{st}*(2*n+1)*\pi/(2*l) \text{ and, } \alpha_{st}=(k_{st}/(c_{st}*\rho_{st}))^{1/2}$$

with said calculated boundary being used to determine $k_a$ as a function of temperature from the molten phase through the solidus temperature, using additional thermal properties of specific heat and density for said metal stored in the software program, and using stored thermal properties of specific heat, thermal conductivity, and density for the die material, whereby a fitting of said calculated boundary, $u_b(t)$, to the plot of a stored boundary temperature $u_b(t)$ data obtained by the alloy-die surface thermocouple is from a casting operation, in which the properties of the alloy material cast and the properties of the die material used in constructing said die are those of the calculated plot, where a wall thickness of 2 times d in the calculated plot is equal to a wall thickness at the location where the thermocouple boundary data was taken, and where an initial metal temperature $u_{ai}$ for a calculated plot is the same as an initial metal temperature $u_{ai}$ for the thermocouple plot and an initial die temperature $u_{si}$ for a calculated plot equals an initial die temperature $u_{si}$ for the thermocouple plot.

6. A method of improving a pressure die casting process by controlling an injection phase of an operation of a die casting machine through application of equations derived by equating a heat flow from an injected solidifying alloy wall to heat entering a die material, said derived equations are for calculating temperature vs. time at varying depths in a solidifying alloy wall, for calculating temperature vs. time at varying depths in a die, for calculating temperature vs. time at a boundary surface between the alloy wall and the die, and a quantity of heat transferred from the alloy to the die vs. time, with said equations used to determine a maximum and minimum time for injection of metal into a cavity by using a computer software program to calculate said equations for determining a solidification progression or solidification pattern, Isoclines, determining a dynamic liquidus and a dynamic solidus in a selected wall of a casting, and calculating an amount of heat remaining Q(t) in said wall above the dynamic solidus, where said wall is formed by a stationary cover die and an ejector die assembly which define the cavity therebetween when a die is in its closed position, wherein said process a thermocouple in a path of molten metal poured into a metal injection sleeve is used to detect and store in said computer program an initial molten metal temperature as a value of $u_{ai}$ in said equations, with one or more locations of said cavity's surface probed with one or more pyrometers an instant before the machine closes to detect said location's surfaces temperature, using a means for preparing and transmitting transmitting one or more pyrometer signals for digital storage as data in the software program and this data is to be used as $u_{si}$, and having a set of alloy thermal properties consisting of specific heats, an alloy density, and an alloy thermal conductivity, and having a set of die material thermal properties consisting of specific heat, density and conductivity stored in the computer, and at least one wall thickness of 2 times d for a pyrometer sensing location/s is manually entered and stored in the software program to provide a value d, whereby values for three variables $u_{ai}$, $u_{si}$, d, and thermal properties for the alloy and the die material stored in the software program are all used for calculating and plotting the equation for $u_b(t)$, an Alloy-Die Surface Boundary, at selected wall location/s, $$u_b(t) = \left(2*(u_{ai}-u_l)*k_a/d*\sum \mathrm{Exp}\left(-\lambda_{al}^{liq}\wedge 2*t\right)+2*u_l*k_a/d*\sum \mathrm{Exp}(-\lambda_{al}^{ls}\wedge 2*t)+2*u_{si}*k_{st}/l*\sum \mathrm{Exp}(-\lambda_{st}\wedge 2*t)\right)\Big/\left(2*k_{st}/l*\sum \mathrm{Exp}(-\lambda_{st}\wedge 2*t)+2*k_a/d*\sum \mathrm{Exp}(-\lambda_{al}^{ls}\wedge 2*t)\right)$$

where:

$\lambda_{al}=\alpha_{al}^{liq}*(2*n1)*\pi/(2*d)$ and, $\alpha_{al}^{liq}=(k_{st}/c_p^{liq}*\rho_{al})^{1/2}$ and, $\lambda_{al}=\alpha_{al}^{ls}*(2*n1)*\pi/(2*d)$ and, $\alpha_{al}^{ls}=(k_{st}/c_p^{ls}*\rho_{al})^{1/2}$ and, $\lambda_{st}=\alpha_{st}*(2*n+1)*\pi/(2*l)$ and, $\alpha_{st}=(k_{st}/(c_{st}*\rho_{st}))^{1/2}$ t=time $u_b(t)$=calculated boundary temperature or alloy-die surface temperature as a function of time, $u_{ai}$=metal temperature (initial) or alloy pouring temperature of the molten alloy, $u_l$=liquidus temperature of molten alloy, $u_{st}$=temperature (initial) of die at t=0 from a pyrometer, d=half-thickness of alloy wall of 2 times d, $c_{pls}$=specific heat of the liquidus-solidus molten alloy $c_{pliq}$=specific heat of the liquidus molten alloy, $\rho_a$=density of the molten alloy, $\alpha_{st}=k_{st}/(c_{st}*\rho_{st})$=diffusivity of the die material, $k_{st}$=thermal conductivity of a die material, $c_{st}$=specific heat of a die material, $\rho_{st}$=density of a die material, l=a thickness of die material >20×d,

π=3.1416,

Exp(n)=base $e^n$ or $2.71828182845904^n$,

Σ=summation from 0 to n and with said Alloy-Die Surface Boundary used for calculating and plotting the injected alloy wall solidification pattern, Isoclines, using the equation, $$u_a(x<=d,t)=u_b+4/\pi*\{(u_{ai}-u_l)*\sum((-1)^n/(2*n+1))*\mathrm{EXP}(-(((k_{st}/(c_{pliq}*\rho a))^{.5}*(2*n+1)*\pi/(2*d))\wedge 2*t))*\mathrm{COS}(((2*n+1)*\pi*x)/(2*d))+(u_l-u_b)*\sum((-1)^n/(2*n+1))*\mathrm{EXP}(-(((k_{st}/(c_{pls}*\rho a))^{.5}*(2*n+1)\cdot\pi/(2*d))\wedge 2*t))*\mathrm{COS}(((2*n+1)*\pi*x)/(2*d))\}.$$

where:

x=distance from center line of the alloy wall equal to or less than d, $u_a(x<=d, t)$=calculated temperature of an alloy as a function of depth & time, Cos=trigonometric cosine, and for calculating and plotting a set of heating lines in a die material using the equation, $$u_s(d=<x<l,t)=u_b+4*(u_{st}-u_b)/\pi*\Sigma(1/(2n+1))*\mathrm{EXP}(-((\alpha_{st}*(2*n+1)*\pi/(2*l))\hat{}2*t))*\mathrm{SIN}(((2*n+1)*\pi*(x_s-d)/(2*l))$$

where:

$x_s$=a depth in a die material equal to or greater than d, $u_s(d=<x<l, t)$=temperature of die material as a function of depth & time, Sin=trigonometric sine, and calculating an amount of heat remaining above the dynamic solidus temperature, using the equation, $$Q(t)=2*k_a/d\left\{(u_{ai}-u_l)*\left[\sum\frac{e-\lambda_l^2*t}{-\lambda_l^2}-\sum\frac{1}{-\lambda_l^2}\right]+(u_l-u_b)*\left[\sum\frac{e-\lambda_{ls}^2*t}{-\lambda_{ls}^2}-\sum\frac{1}{-\lambda_{ls}^2}\right]\right\}$$

where:

$\lambda_l=(k_{st}/(c_{pliq}*\rho_a))^{0.5}*(2*n+1)*\pi/(2*d)$ and, $\lambda_{ls}=(k_{st}/(c_{pls}*\rho_a))^{0.5}*(2*n+1)*\pi(2*d)$ with said solidification pattern and heat calculations, Q(t), being used for establishing a maximum and minimum limit for the fill time and whereby, for comparison purposes with that fill time, a pressure transducer means is provided in a die casting die or in a die casting machine injection cylinder for detection of an injection pressure whereupon this pressure signal is converted to digital data for entry and storage in said software program and this data is used by the computer program to plot an injection pressure-time graph for fill time, with said fill time to be controlled and set for the selected wall location automatically for a next cycle by said computer program within the Isoclines determination of the dynamic solidus and the dynamic liquidus thereby setting limits for the maximum and minimum fill time and/or using the heat calculation, Q(t), for establishing the time range within which fill time is to be controlled and set, all based on a calculated boundary $u_b(t)$.

7. The pressure die casting process described in claim 6 wherein a die contains a plurality of movable die members to form a cavity and one or more of said movable die member's surface is probed with one or more pyrometers an instant before the casting machine closes to detect said surface's temperature, using a means for preparing and transmitting one or more pyrometer signals for storage as data in a software program as $u_{si}$ thence calculating the Alloy-Die Temperature Boundary $u_b(t)$ with said calculated value $u_b(t)$ used in the computer software program for calculating a solidification pattern as in claim 6 and calculating an amount of heat, Q(t), remaining above a dynamic solidus as in claim 6 with said solidification pattern and/or heat calculations Q(t) being used for establishing the maximum and minimum for the fill time, and using a means provided in said die casting die or in said machine injection cylinder for detection of an injection pressure whereupon a pressure signal is used by said computer for plotting an injection pressure-time graph for fill time at a movable member wall location, with said fill time to be controlled and set automatically for a next cycle by said computer program within Isoclines determination of the dynamic solidus and the dynamic liquidus thereby setting limits for the maximum and minimum fill time and/or by using the heat calculation Q(t) for establishing the time range within which the fill time is to be controlled and set all based on the calculated boundary $u_b(t)$ as in claim 6.

8. The pressure die casting process described in claim 6 wherein the die casting machine contains a means for intensification of an injection pressure, whereupon a time of actuation of said intensification means and control and setting of fill time for a next cycle is automatic by said computer program within Isoclines determination of the dynamic solidus and the dynamic liquidus, thereby setting limits for the maximum and minimum fill time and/or using the heat calculation Q(t) for establishing the time range within which the fill time is to be controlled and set as in claim 6.

9. The pressure die casting process described in claim 6 wherein a die casting machine contains a means for intensification of an injection pressure, a casting die with a plurality of die members to form a cavity and one or more auxiliary movable die members has its surface probed with a pyrometer an instant before the machine closes to detect said surface's temperature, using a means for preparing and transmitting said one or more pyrometer signals for digital storage as data in said software program as $u_{si}$ thence calculating an Alloy-Die Temperature Boundary temperature, $u_b(t)$, with said calculated value of $u_b(t)$, used in said computer software program as in claim 6, and using a means for detection of a time of actuation of an intensifier and means for detection of fill time to be used in said computer software program as in claim 6, wherein said computer program determines and/or automatically sets a timing for actuation of said intensifier as well as control and setting of fill time for a next cycle as in claim 6.

* * * * *